US005590911A

United States Patent [19]

Wilson

[11] Patent Number: 5,590,911

[45] Date of Patent: Jan. 7, 1997

[54] EVENT PLANNING SYSTEM

[76] Inventor: Linda D. Wilson, 8540 Huntington Park Dr., #218, New Orleans, La. 70127

[21] Appl. No.: 565,233

[22] Filed: Nov. 30, 1995

[51] Int. Cl.[6] ..... B42F 21/00

[52] U.S. Cl. ..... 283/36; 283/37; 283/38; 283/42; 402/73

[58] Field of Search ..... 283/36, 37, 38, 283/39–42, 117; 402/70, 73; 281/29

[56] References Cited

U.S. PATENT DOCUMENTS

| | | | |
|---|---|---|---|
| D. 281,056 | 10/1985 | de la Tour | 337/35 |
| 3,700,264 | 10/1972 | Friedman | 283/38 |
| 4,575,126 | 3/1986 | Grubbs | 283/38 |
| 4,669,754 | 6/1987 | Lalonde | 283/67 |
| 5,127,674 | 7/1992 | Lamphere et al. | 283/67 X |
| 5,294,208 | 3/1994 | Tremmel, Jr. et al. | 402/73 X |
| 5,489,120 | 2/1996 | Thornsburg | 402/73 X |

*Primary Examiner*—Willmon Fridie, Jr.
*Attorney, Agent, or Firm*—Joseph N. Breaux

[57] ABSTRACT

An event planning system of the type having a plurality of index-tabbed planning stage sections containing instruction sheets, preprinted forms and storage containers assembled in a book-like form within a cover is provided. The event planning system comprises: a front cover and a rear cover; a business card holder defining card compartments for disposing business cards therein, the card holder being held between the covers; a storage envelope for holding documents therein, the envelope being held between the covers; a container for storing supplies therein, the container being held between the covers; and a plurality of planning stage sections assembled in book-like form between the covers, each section comprising: a primary divider sheet having a projecting primary index tab bearing primary indicia thereon indicating the planning stage represented by the section; at least one instruction sheet having instructions for performing the planning stage; and at least one preprinted form having linear indicia adapted to record data regarding accomplishing the planning stage.

20 Claims, 3 Drawing Sheets

EVENT PLANNING SYSTEM

TECHNICAL FIELD

The present invention relates to devices for planning and organizing a tension filled event and more particularly to devices for planning and organizing an event that have a front cover and a rear cover containing material divided into a plurality of sections utilizing a four step planning system therein.

BACKGROUND ART

Planning and organizing an event such as a wedding can be a very tedious, time consuming and pressure packed process. For this reason, a continuous stream of articles and books on how to plan and organize events have been presented. However, these items only provide a plethora of questions and check lists to help negotiate the tension filled path of planning and organizing an event. There are agenda systems, project workbooks and the like for organizing material. However, these prior art devices do not present an easy to follow and organized system for planning an event.

It would be a benefit, therefore, to have a planning system containing instructions and preprinted forms for planning an event within a loose leaf binder. It would be an additional benefit, to have divider sheets provided with projecting index tabs for dividing the contained material into sections. It would be a further benefit, to have a planning system that includes envelopes for storing important documents and receipts. It would be a still further benefit, to have a planning system that includes tools such as pens, pencils, scissors and the like often required in the process of organizing an event.

GENERAL SUMMARY DISCUSSION OF INVENTION

It is thus an object of the invention to provide an event planning system that has a front cover and a rear cover containing instructions and preprinted forms for planning an event therebetween.

It is a further object of the invention to provide an event planning system that has divider sheets each having a projecting index tab bearing indicia thereon for dividing the contained information into sections.

It is a still further object of the invention to provide an event planning system that has storage pouches for holding important papers, receipts and the like.

It is a still further object of the invention to provide an event planning system that has various tools such as a writing device, a calculator, a measuring device, and a sewing kit stored therein.

Accordingly, an event planning system of the type having a plurality of index-tabbed planning stage sections containing instruction sheets, preprinted forms and storage containers assembled in a book-like form within a cover is provided. The event planning system comprises: a front cover and a rear cover; a business card holder defining card compartments for disposing business cards therein, the card holder held between the covers; a storage envelope for holding documents therein, the envelope held between the covers; a container for storing supplies therein, the container held between the covers; and a plurality of planning stage sections assembled in book-like form between the covers, each section comprising: a primary divider sheet having a projecting primary index tab bearing primary indicia thereon indicating the planning stage represented by the section; at least one instruction sheet having instructions for performing the planning stage; and at least one preprinted form having linear indicia adapted to record data regarding accomplishing the planning stage.

The front and rear cover may be a loose leaf binder having rings therein for holding the planning stage sections and the supplies. The planning system may be held in an attache binder having a lockable flap. The attache binder may also have a handle attached thereto. The attache binder may further have a shoulder strap. The binder may further define a pocket for disposing a checkbook.

In a preferred embodiment, the event planning system may have twelve planning stage sections. The twelve planning stage sections being titled, respectively, "WEDDING CALENDARS," "WEDDING DIRECTORY," "WEDDING BUDGET," "BRIDAL PARTY," "WEDDING ATTIRE," "WEDDING CEREMONY," "WEDDING RECEPTION," "WEDDING SERVICES," "PARTIES," "HONEYMOON," "PERSONAL AFFAIRS," AND "PLANNING ACCESSORIES." Each section would contain instructions for guiding the user through the planning stage. Each section would further include preprinted forms for record data necessary for planning the wedding thereon. A storage envelope may also be contained in each section.

The first planning stage section titled "WEDDING CALENDARS" may include a four year calendar, monthly calendars and weekly calendars. This section may also include wedding day calendars for both the bride and groom.

The second planning stage section titled "WEDDING DIRECTORY" may include business card holders and lists for recording important names and phone numbers. This section may also include forms for recording the names of guests at showers and the wedding and for describing any gifts received and whether a thank you note has been mailed.

The "PLANNING ACCESSORIES" section may include extra forms for each of the sections. This section may include preprinted labels such as caterer, flowers, hotel, music, photographer, stationary, transportation and wedding cake. This section may also include extra blank tabs and divider sheets. This section may include the container for storing supplies. The supplies may include a pencil, a pen, an eraser, color pencils, a pencil sharpener, a highlighter, a marker and a ruler. The supplies might also include glue, correction fluid, sewing kit having needles and thread, scissors, measuring tapes, a stapler and staple remover. The supplies might also include a hole punch, rubber bands, a tape dispenser, paper clips, a letter opener and a box for storing overflow material.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
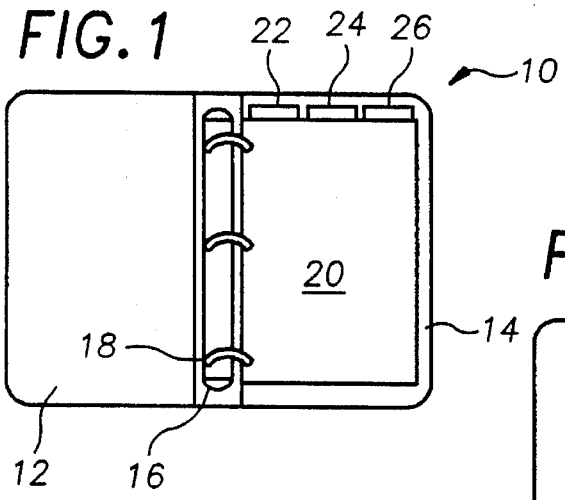
FIG. 1 is an elevational view of the event planning system of the present invention showing the headings of the first three sections.

FIG. 1 is an elevational view of an exemplary embodiment of the event planning system of the present invention generally designated by the numeral 10. Event planning system 10 includes a front cover 12 and a rear cover 14 having a binder 16 therebetween holding a plurality of sections each addressing a separate planning stage, each section containing a plurality of sheets held by rings 18.

A section pertaining to how to use event planning system 10 is introduced by a primary divider sheet 20 have upwardly projecting primary index tab 22 having the indicia "GETTING STARTED" thereon. Held by rings 18 behind primary divider sheet 20 is a plurality of instruction sheets (not shown) explaining the four step system for planning an event incorporated in event planning system 10.

Referring now to FIGS. 1 through 5, event planning system 10 is shown for planning and organizing a wedding. Event planning system 10 has twelve planning stage sections, each section is introduced by a divider sheet having an upwardly projecting index tab bearing indicia thereon. The planning stage sections include: a first section 24 having a first primary divider sheet provided with a projecting primary index tab bearing the indicia "WEDDING CALENDARS" thereon; a second section 26 having a second primary divider sheet provided with a projecting primary index tab bearing the indicia "WEDDING DIRECTORY" thereon; a third section 28 having a third primary divider sheet provided with a projecting primary index tab bearing the indicia "WEDDING BUDGET" thereon; a forth section 30 having a forth primary divider sheet provided with a projecting primary index tab bearing the indicia "BRIDAL PARTY" thereon; a fifth section 32 having a fifth primary divider sheet provided with a projecting primary index tab bearing the indicia "WEDDING ATTIRE" thereon; a sixth section 34 having a sixth primary divider sheet provided with a projecting primary index tab bearing the indicia "WEDDING CEREMONY" thereon; a seventh section 36 having a seventh primary divider sheet provided with a projecting primary index tab bearing the indicia "WEDDING RECEPTION" thereon; an eighth section 38 having a eighth primary divider sheet provided with a projecting primary index tab bearing the indicia "WEDDING SERVICES" thereon; a ninth section 40 having a ninth primary divider sheet provided with a projecting primary index tab bearing the indicia "PARTIES" thereon; a tenth section 42 having a tenth primary divider sheet provided with a projecting primary index tab bearing the indicia "HONEYMOON" thereon; an eleventh section 44 having a eleventh primary divider sheet provided with a projecting primary index tab bearing the indicia "PERSONAL AFFAIRS" thereon; and a twelfth section 48 having a twelfth primary divider sheet 46 provided with a projecting primary index tab bearing the indicia "PLANNING ACCESSORIES" thereon.

Figure 6:
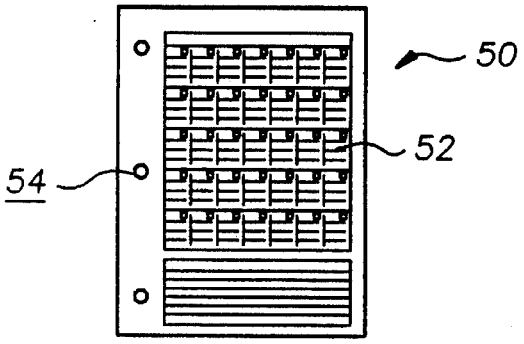
FIG. 6 is an elevational view of a calendar.

FIG. 6 is an elevational view of a calendar 50. Calendar 50 provides a space 52 for each day of the week. Spaces 52 are adapted for recording data relevant to the day of the week represented by the space 52. Calendar 50 forms three holes 54 for attaching calendar 50 to rings 18 (FIG. 1). Twelve calendars 50 are contained within first planning stage section 24 (FIG. 1).

Figure 7:
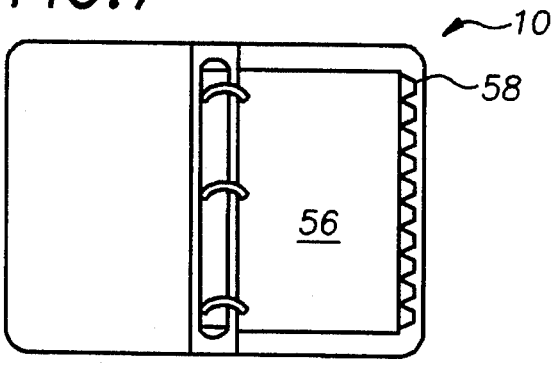
FIG. 7 is an elevational view of the tabbed calendar section.

FIG. 7 is another elevational view of event planning system 10. FIG. 7 shows a secondary divider sheet 56 projecting a secondary index tab 58 bearing the indicia "JAN." Event planning system 10 includes twelve secondary divider sheets 56 projecting a secondary index tab 58 bearing an indicia designating one of the twelve months of the year, in descending sequence on a front face thereof. Behind each secondary divider sheet 56 is a calendar 50 (FIG. 6).

Figure 8:
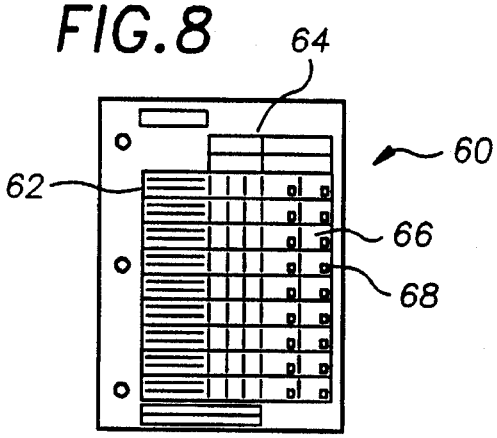
FIG. 8 is an elevational view of a guest form.
Figure 9:
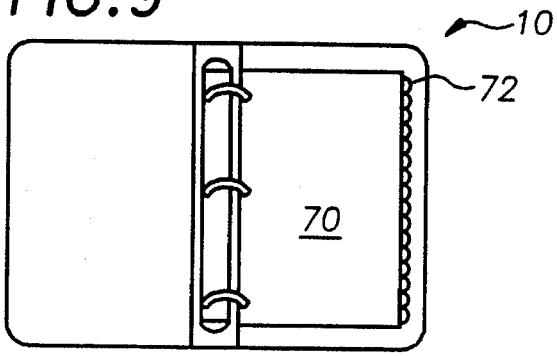
FIG. 9 is an elevational view of the alphabetically-ordered guest forms.

Referring now to FIGS. 8 and 9, a plurality of alphabetically-ordered guest forms 60 are shown as contained within "WEDDING DIRECTORY" section 26 (FIG. 1) of event planning system 10. Guest forms 60 have linear indicia thereon adapted to record the names and addresses of guests 62, data as to invitations for events 64, descriptions of gifts received 66, and data as to the sending of thank you notes 68. FIG. 9 shows a tertiary divider sheet 70 having a projecting index tab 72 bearing the indicia "A." The index tabs only of the tertiary divider sheets designating the alphabet "B–Z" are also shown. Behind each tertiary divider sheet having an index tab bearing a letter of the alphabet is a plurality of guest forms 60.

Figure 2:
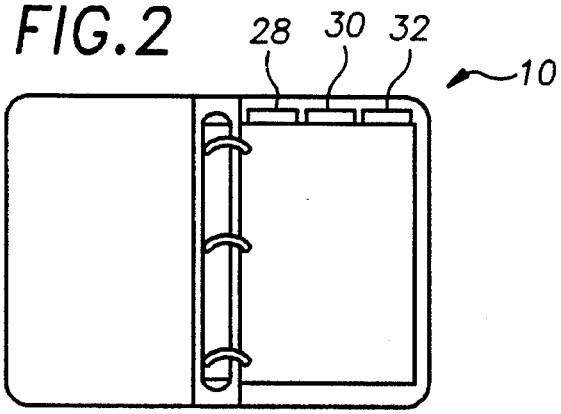
FIG. 2 is an elevational view of the event planning system showing the headings of the second three sections.
Figure 3:
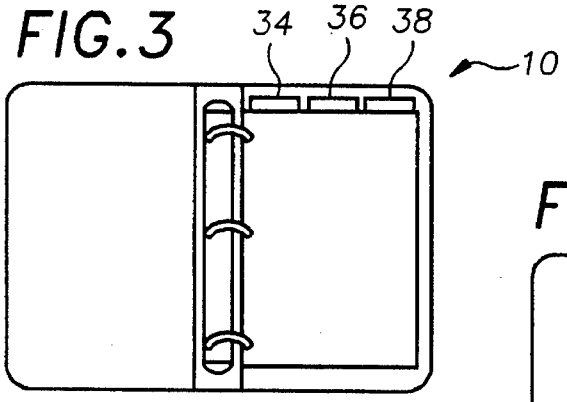
FIG. 3 is an elevational view of the event planning system showing the headings of the next three sections.
Figure 4:
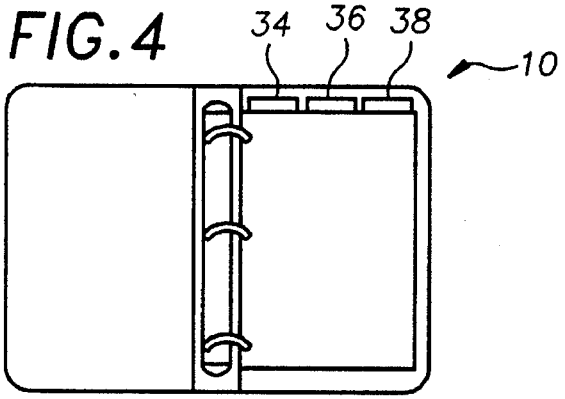
FIG. 4 is an elevational view of the event planning system showing the headings of the next three sections.
Figure 5:
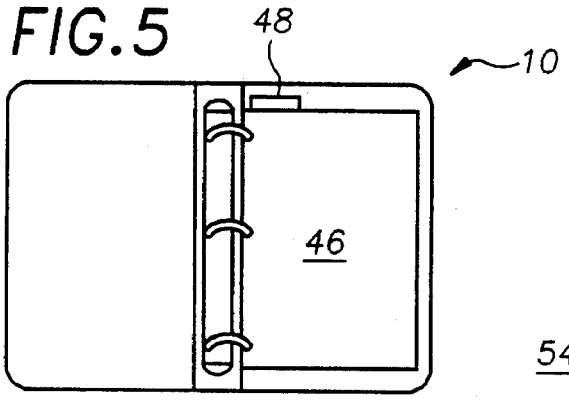
FIG. 5 is an elevational view of the event planning system showing the headings of the last section.
Figure 10:
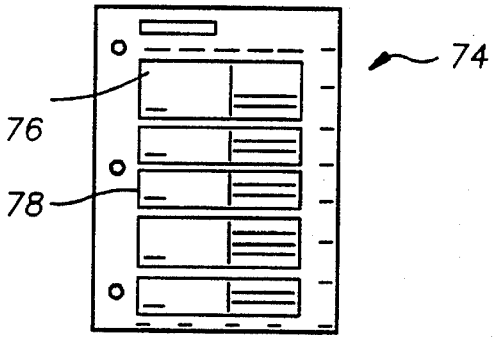
FIG. 10 is an elevational view of a planning form.

FIG. 10 is an elevational view of an example of a planning form 74. Planning form 74 has linear indicia for recording options in selecting wedding attire 76 and estimates 78 of the cost of such options. Planning form 74 is contained within fifth section 32 (FIG. 2).

Figure 11:
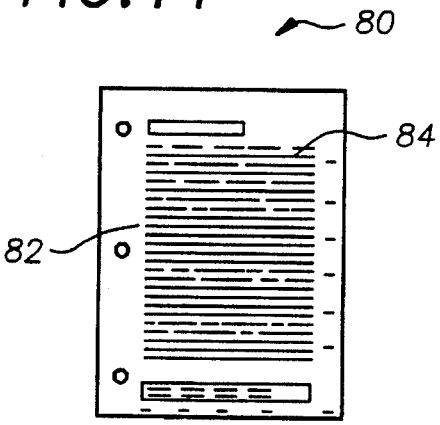
FIG. 11 is an elevational view of an organizing form.

FIG. 11 is an elevational view of an example of an organizing form 80. Organizing form 80 has linear indicia for recording items selected 82 and appointments 84 among other important data. Organizing form 80 is contained within fifth section 32 (FIG. 2).

Figure 12:
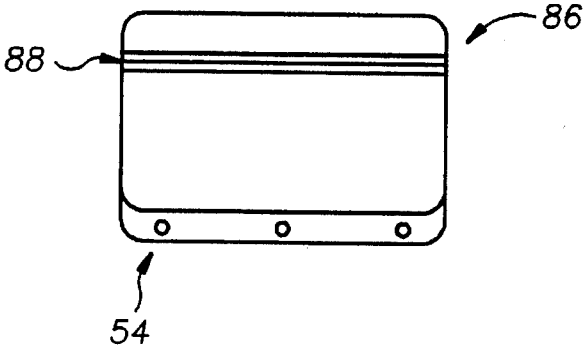
FIG. 12 is an elevational view of the storage container.

FIG. 12 is an elevational view of a container 86 for storing supplies. Container 86 is constructed of a transparent plastic forming an opening 88 for placing supplies into container 86. Supplies (not shown) such as writing devices, calculators, measuring devices, sewing kits, scissors and the like are removably held within container 86. Container 86 forms three holes 54 for connecting container 86 to rings 18 (FIG. 1).

Figure 13:
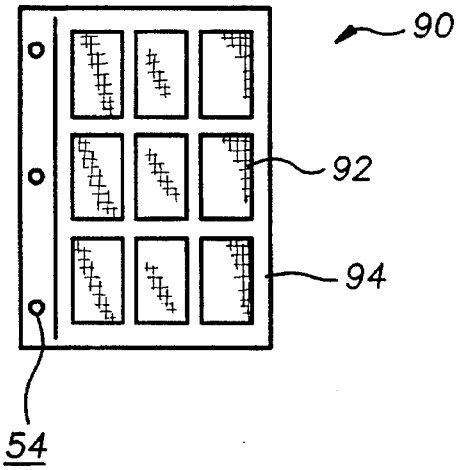
FIG. 13 is an elevational view of the swatch board.

FIG. 13 is an elevational view of a swatch board 90. Swatch board 90 is substantially rigid and constructed of card board. A plurality of fabric swatches 92 are connected glueing to a first surface 94 of swatch board 90. Swatch board 90 forms three holes 54 for connecting to rings 18 (FIG. 1).

Figure 14:
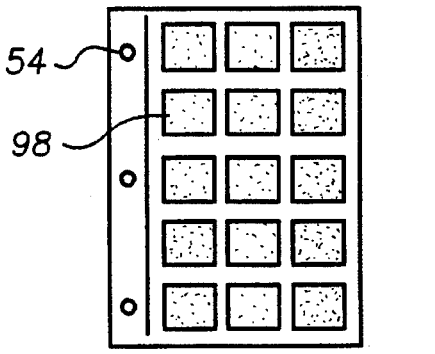
FIG. 14 is an elevational view of the color chart.

FIG. 14 is an elevational view of a color chart 96. Color chart 96 has a plurality of colored blocks 98 thereon. Three holes 54 are provided for connecting color chart 96 to rings 18 (FIG. 1).

Figure 15:
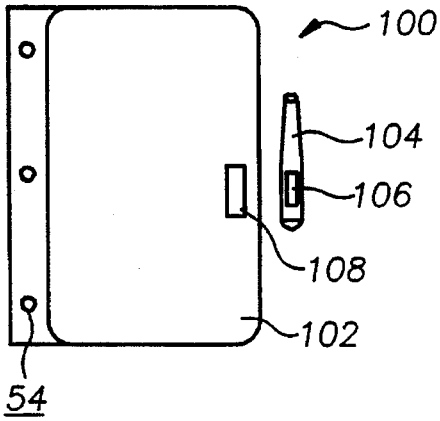
FIG. 15 is an elevational view of the sketch board and dry erase marker.

FIG. 15 is an elevational view of a sketch board 100. Sketch board 100 is constructed of a rigid material having a writing surface 102. A dry erase marker 104 is provided for marking on writing surface 102. Marker 104 is removably connectable to board 100 by a first hook and loop fastener 106 connected to marker 104 and a second hook and loop fastener 108 connected to writing surface 102. A cloth strip 110 is connected by glueing to board 100, providing three holes 54 therethrough for connecting board 100 to rings 18 (FIG. 1).

Figure 16:
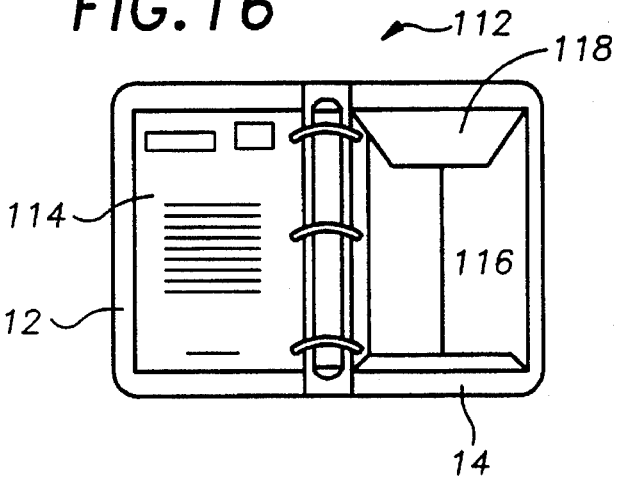
FIG. 16 is an elevational view of a storage envelope.

FIG. 16 is an elevational view of a storage envelope 112 held between front cover 12 and rear cover 14. Storage envelope 112 has a front surface 114 having lines drawn thereon for recording the contents held within envelope 112. A rear surface 116 of a storage envelope 112 is shown on rear cover 14. A flap 118 is folded over rear surface 118 holding any documents within envelope 112.

Figure 17:
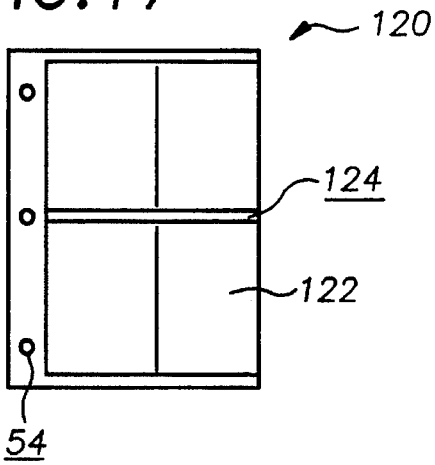
FIG. 17 is an elevational view of a diskette holder.

FIG. 17 is an elevational view of a diskette holder 120. Diskette holder 120 is formed of a flexible, transparent plastic defining four diskette compartments 122 for holding computer disks (not shown). Each diskette compartment 122 forms a slot 124 for disposing a disk therethrough. Three holes 54 are formed through diskette holder 120 for connecting to rings 18 between covers 12,14 (not shown).

Figure 18:
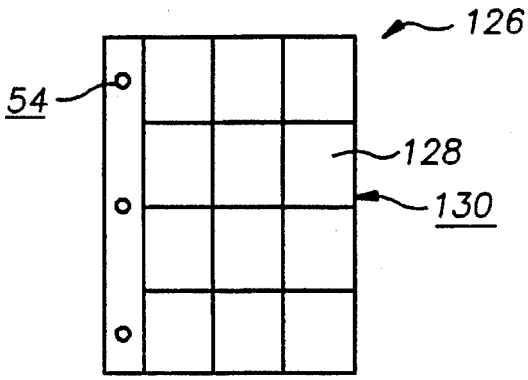
FIG. 18 is an elevational view of a business card holder.

FIG. 18 is an elevational view of a business card holder 126. Business card holder 126 is formed of a flexible, transparent plastic defining a plurality of card compartments 128 for holding business cards. Each card compartment 128 forms a slot 130 for disposing a business card. Three holes 54 are formed through business card holder 126 for connecting to rings 18 between covers 12,14 (not shown).

It can be seen from the preceding description that a device for planning and organizing an event which has a front cover and a rear cover containing instructions and preprinted forms for planning an event therebetween, has divider sheets each having a projecting index tab bearing indicia thereon for dividing the contained information into sections, has storage pouches for holding important papers, receipts and the like, and has various tools such as a writing device, a calculator, a measuring device, and a sewing kit stored therein has been provided.

It is noted that the embodiment of the event planning system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An event planning system comprising:

a front cover and a rear cover;

a business card holder defining card compartments for disposing business cards therein, said card holder being held between said covers;

a storage envelope for holding documents therein, said envelope being held between said covers;

a container for storing supplies therein, said container being held between said covers; and a plurality of planning stage sections assembled in book-like form between said covers, each said planning stage section comprising:

a primary divider sheet provided with a projecting primary index tab bearing primary indicia thereon indicating a planning stage addressed by said section;

at least one instruction sheet having instructions printed thereon for performing said planning stage; and preprinted forms having linear indicia adapted to record data regarding accomplishing said planning stage.

2. The event planning system of claim 1, wherein: said supplies includes:

a writing device;

a calculator;

a measuring device; and a sewing kit.

3. The event planning system of claim 1, further including:

a substantially rigid board having fabric swatches thereon; and a color chart;

said board and said color chart being held between said covers.

4. The event planning system of claim 1, further including:

a sketch board having a writing surface thereon, said sketch board held between said covers; and a dry erase marker for writing on said writing surface, said marker being removably connectable to said sketch board.

5. The event planning system of claim 1, further including:

a diskette holder for storing computer diskettes, said holder being removably held between said covers.

6. The event planning system of claim 1, wherein:

said storage envelope has a front surface having lines marked thereon adapted for recording the contents held in said storage envelope.

7. The event planning system of claim 1, wherein: said preprinted forms includes:

planning forms having linear indicia thereon for recording options and estimates during said planning stage; and organizing forms having linear indicia thereon for recording appointments and data regarding decisions.

8. The event planning system of claim 7, wherein: said supplies includes:

a writing device;

a calculator;

a measuring device; and a sewing kit;

said event planning system further including:

a sketch board having a writing surface thereon, said sketch board held between said covers;

a dry erase marker for writing on said writing surface, said marker being removably connectable to said sketch board;

a substantially rigid board having fabric swatches thereon, said board being held between said covers;

a color chart, said color chart being held between said covers; and a diskette holder form storing computer diskettes, said holder being held between said covers.

9. The event planning system of claim 1, wherein: said plurality of planning stage sections includes:

a first section having a first primary divider sheet provided with a projecting primary index tab bearing the indicia "WEDDING CALENDARS" thereon;

a second section having a second primary divider sheet provided with a projecting primary index tab bearing the indicia "WEDDING DIRECTORY" thereon;

a third section having a third primary divider sheet provided with a projecting primary index tab bearing the indicia "WEDDING BUDGET" thereon;

a forth section having a forth primary divider sheet provided with a projecting primary index tab bearing the indicia "BRIDAL PARTY" thereon;

a fifth section having a fifth primary divider sheet provided with a projecting primary index tab bearing the indicia "WEDDING ATTIRE" thereon;

a sixth section having a sixth primary divider sheet provided with a projecting primary index tab bearing the indicia "WEDDING CEREMONY" thereon;

a seventh section having a seventh primary divider sheet provided with a projecting primary index tab bearing the indicia "WEDDING RECEPTION" thereon;

an eighth section having an eighth primary divider sheet provided with a projecting primary index tab bearing the indicia "WEDDING SERVICES" thereon;

a ninth section having a ninth primary divider sheet provided with a projecting primary index tab bearing the indicia "PARTIES" thereon;

a tenth section having a tenth primary divider sheet provided with a projecting primary index tab bearing the indicia "HONEYMOON" thereon;

an eleventh section having an eleventh primary divider sheet provided with a projecting primary index tab bearing the indicia "PERSONAL AFFAIRS" thereon; and a twelfth section having a twelfth primary divider sheet provided with a projecting primary index tab bearing the indicia "PLANNING ACCESSORIES" thereon.

10. An event planning system comprising:

a front cover and a rear cover;

a business card holder defining card compartments for disposing business cards therein, said card holder being held between said covers;

a diskette holder for storing computer diskettes, said holder being held between said covers a storage envelope for holding documents therein, said envelope having a front surface having lines marked thereon adapted for recording the contents held therein, said envelope being held between said covers;

a sketch board having a writing surface thereon, said sketch board being held between said covers;

a dry erase marker for writing on said writing surface of said sketch board, said marker being removably connectable to said sketch board;

a container held between said covers for storing supplies therein: and a plurality of planning stage sections assembled in book-like form between said covers, each said planning stage section comprising:

a primary divider sheet provided with a projecting primary index tab bearing primary indicia thereon indicating a planning stage addressed by said section;

at least one instruction sheet having instructions printed thereon for performing said planning stage; and preprinted forms having linear indicia adapted to record data regarding accomplishing said planning stage.

11. The event planning system of claim 10, wherein: said preprinted forms includes:

planning forms having linear indicia thereon for recording options and estimates during said planning stage; and organizing forms having linear indicia thereon for recording appointments and data regarding decisions.

12. The event planning system of claim 11, wherein: said plurality of planning stage sections includes:

a first section having a first primary divider sheet provided with a projecting primary index tab bearing the indicia "WEDDING CALENDARS" thereon;

a second section having a second primary divider sheet provided with a projecting primary index tab bearing the indicia "WEDDING DIRECTORY" thereon;

a third section having a third primary divider sheet provided with a projecting primary index tab bearing the indicia "WEDDING BUDGET" thereon;

a forth section having a forth primary divider sheet provided with a projecting primary index tab bearing the indicia "BRIDAL PARTY" thereon;

a fifth section having a fifth primary divider sheet provided with a projecting primary index tab bearing the indicia "WEDDING ATTIRE" thereon;

a sixth section having a sixth primary divider sheet provided with a projecting primary index tab bearing the indicia "WEDDING CEREMONY" thereon;

a seventh section having a seventh primary divider sheet provided with a projecting primary index tab bearing the indicia "WEDDING RECEPTION" thereon;

an eighth section having an eighth primary divider sheet provided with a projecting primary index tab bearing the indicia "WEDDING SERVICES" thereon;

a ninth section having a ninth primary divider sheet provided with a projecting primary index tab bearing the indicia "PARTIES" thereon;

a tenth section having a tenth primary divider sheet provided with a projecting primary index tab bearing the indicia "HONEYMOON" thereon;

an eleventh section having an eleventh primary divider sheet provided with a projecting primary index tab bearing the indicia "PERSONAL AFFAIRS" thereon; and a twelfth section having a twelfth primary divider sheet provided with a projecting primary index tab bearing the indicia "PLANNING ACCESSORIES" thereon.

13. The event planning system of claim 12, wherein: said first planning stage section, designated "WEDDING CALENDARS," further includes:

twelve calendars, each said calendar representing a month; and each said calendar being separated from other said calendars by a secondary divider sheet projecting a secondary index tab bearing an indicia designating one of the twelve months of the year, in descending sequence on a front face thereof.

14. The event planning system of claim 12, wherein: said second planning stage section, designated "WEDDING DIRECTORY," further includes:

a plurality of alphabetically-ordered guest forms, said guest forms having linear indicia thereon adapted to record the names and addresses of guests, data as to invitations for events, descriptions of gifts received, and data as to the sending of thank you notes.

15. The event planning system of claim 13, wherein: said second planning stage section, designated "WEDDING DIRECTORY," further includes:

a plurality of alphabetically-ordered guest forms, said guest forms having linear indicia thereon adapted to record the names and addresses of guests, data as to invitations for events, descriptions of gifts received, and data as to the sending of thank you notes.

16. The event planning system of claim 12, further including:

a substantially rigid board having fabric swatches thereon, said board being held between said covers.

17. The event planning system of claim 16, wherein:

a color chart held between said covers.

18. An event planning system comprising:

a front cover and a rear cover;

a business card holder defining card compartments for disposing business cards therein, said card holder being held between said covers;

a diskette holder for storing computer diskettes, said holder being held between said covers a storage envelope for holding documents therein, said envelope having a front surface having lines marked thereon adapted for recording the contents held therein, said envelope being held between said covers;

a sketch board having a writing surface thereon, said sketch board being held between said covers;

a dry erase marker for writing on said writing surface of said sketch board, said marker being removably connectable to said sketch board;

a container held between said covers for storing supplies therein, said supplies including:

a writing device;

a calculator;

a measuring device; and a sewing kit;

a first planning stage section having a first primary divider sheet provided with a projecting primary index tab bearing the indicia "WEDDING CALENDARS" thereon;

said first planning stage section having twelve calendars held therein, each said calendar representing a single month;

each said preprinted calendar being separated from other said calendars by a secondary divider sheet projecting a secondary index tab bearing an indicia designating one of the twelve months of the year, in descending sequence on a front face thereof;

a second planning stage section having a second primary divider sheet provided with a projecting primary index tab bearing the indicia "WEDDING DIRECTORY" thereon;

said second planning stage section having a plurality of alphabetically-ordered guest forms held therein, said guest forms having linear indicia thereon adapted to record the names and addresses of guests, data as to invitations for events, descriptions of gifts received, and data as to the sending of thank you notes;

a third planning stage section having a third primary divider sheet provided with a projecting primary index tab bearing the indicia "WEDDING BUDGET" thereon;

a forth planning stage section having a forth primary divider sheet provided with a projecting primary index tab bearing the indicia "BRIDAL PARTY" thereon;

a fifth planning stage section having a fifth primary divider sheet provided with a projecting primary index tab bearing the indicia "WEDDING ATTIRE" thereon;

a sixth planning stage section having a sixth primary divider sheet provided with a projecting primary index tab bearing the indicia "WEDDING CEREMONY" thereon;

a seventh planning stage section having a seventh primary divider sheet provided with a projecting primary index tab bearing the indicia "WEDDING RECEPTION" thereon;

an eighth planning stage section having an eighth primary divider sheet provided with a projecting primary index tab bearing the indicia "WEDDING SERVICES" thereon;

a ninth planning stage section having a ninth primary divider sheet provided with a projecting primary index tab bearing the indicia "PARTIES" thereon;

a tenth planning stage section having a tenth primary divider sheet provided with a projecting primary index tab bearing the indicia "HONEYMOON" therein;

an eleventh planning stage section having an eleventh primary divider sheet provided with a projecting primary index tab bearing the indicia "PERSONAL AFFAIRS" thereon; and a twelfth planning stage section having a twelfth primary divider sheet provided with a projecting primary index tab bearing the indicia "PLANNING ACCESSORIES" thereon.

said planning stage sections being assembled in book-like form between said covers; and said planning stage sections including:

an instruction sheet having instructions printed thereon for performing said planning stage; and preprinted forms having linear indicia adapted to record data regarding accomplishing said planning stage.

19. The event planning system of claim 18, wherein: said preprinted forms includes:

planning forms having linear indicia thereon for recording options and estimates during said planning stage; and organizing forms having linear indicia thereon for recording appointments and data regarding decisions.

20. The event planning system of claim 19, further including:

a substantially rigid board having fabric swatches thereon; and a color chart;

said board and said color chart being held between said covers.

* * * * *